US005365028A

United States Patent [19]

Takano

[11] Patent Number: 5,365,028

[45] Date of Patent: Nov. 15, 1994

[54] SLIDE SWITCHES

[75] Inventor: Tsunesuke Takano, Tokyo, Japan

[73] Assignee: Kabushiki Kaisha T AN T, Japan

[21] Appl. No.: 101,304

[22] Filed: Aug. 3, 1993

[51] Int. Cl.[5] ..... H01H 15/06

[52] U.S. Cl. ..... 200/547; 200/549; 200/550; 200/16 R

[58] Field of Search ..... 200/547, 549, 550, 16 R, 200/16 A, 16 D, 16 E, 16 F, 548, 537

[56] References Cited

U.S. PATENT DOCUMENTS

| | | | |
|---|---|---|---|
| 4,191,867 | 3/1980 | Feaster | 200/16 R |
| 4,210,791 | 7/1980 | Sorenson | 200/550 |
| 4,825,020 | 4/1989 | Rao et al. | 200/550 |
| 5,051,549 | 9/1991 | Takano | 200/549 |

*Primary Examiner*—Henry J. Recla
*Assistant Examiner*—David J. Walczak
*Attorney, Agent, or Firm*—Nixon & Vanderhyde

[57] ABSTRACT

Slide switches include an electrically insulated support housing having opposing pairs of side walls which establish an interior space. An upper wall is joined to an upper edge of the opposing pairs of side walls to close an upper end of the interior space and defines an opening in communication with the interior cavity. An electrically insulated slide body which is slidably disposed within the interior space of the support housing so as to be movable reciprocally between at least first and second positions therewithin. The slide body also defines a cavity and has a knob which projects through the opening defined in the upper wall of the support housing to allow movement of the slide body between the first and second positions. At least one pair of elongate conductors are fixed to the support housing such that the at least one pair of fixed elongate conductors extend parallel to one another but are positioned in spaced relationship transversely relative to the reciprocal movement of the slide body. The slide body includes an electrically conductive movable contact disposed in the cavity. This movable contact has a protruding contact surface which contacts both the fixed conductors when the slide body is in at least one of the first and second positions. In addition, the movable contact has an opposed pair of upturned sides which exert a bias force outwardly against the slide body cavity and to thereby frictionally retain the conductive strip within the cavity.

6 Claims, 6 Drawing Sheets

SLIDE SWITCHES

RELATED PATENTS

This application is related to U.S. Pat. No. 5,051,549 issued on Sep. 24, 1991, the entire content of which is expressly incorporated hereinto by reference.

FIELD OF INVENTION

The present invention relates to slide switches. More particularly, the present invention relates to slide switches having a movable conductor which serves as a movable contact and a number of relatively narrow fixed parallel conductors (i.e., so-called bus bars). An electrical circuit is thus made when the movable contact bridges at least one pair of the fixed conductors.

BACKGROUND AND SUMMARY OF THE INVENTION

As noted above, this invention is related to, and is an improvement of, the slide switch disclosed in U.S. Pat. No. 5,051,549 (hereinafter more simply referred to as "the '549 Patent"). In this regard, the slide switch of the '549 Patent includes an electrically insulated slide body which is slidably disposed within an interior cavity defined in an electrically insulated support housing. The slide body has a knob which projects through an opening defined in an upper wall of the support housing so as to allow manual movement of the slide body between its first and second positions. At least one pair of elongated conductors is provided in the slide switch according to the '549 Patent such that the conductors' opposed ends are fixed to an opposed pair of side walls of the housing and are thus disposed parallel to one another, but positioned in spaced relationship transversely relative to the reciprocal movement of the slide body within the support housing.

The slide body of the slide switch according to the '549 Patent carries a movable conductor which is sized and configured so as to be in contact with the pair of elongated fixed conductors when the slide body is in its first position so as to make an electrical circuit therebetween. More specifically, the movable conductor of the slide switch according to the '549 Patent is disclosed as preferably being a spherical conducting member which is seated within an interior hollow portion of the knob of the slide body and urged into contact with the fixed conductors by means of a compression spring. Also, the possibility of the conductor being in the form of a U-shaped piece is noted at column 3, lines 9–12 of the '549 Patent.

There exists the possibility, however, that the combination of a spherical conducting member will present some problems during manufacture of the slide switch according to the '549 Patent. That is, since the spherical conducting member must be depressed against the bias force of the compression spring during manufacture, there is the possibility that the spherical conducting member and/or the spring will be forcibly expelled from the interior hollow of the slide switch knob prior to final assembly. Thus, positionally maintaining the spherical conducting member/compression spring prior to final assembly becomes a tedious task when accomplished manually and is problematic when assembly is accomplished automatically (e.g., via robotics).

It would therefore be desirable if a slide switch was provided having the beneficial attributes of the slide switch disclosed in the '549 Patent, but without at least some of the possible problems during manufacturing as noted above. It is towards providing such an improved slide switch that the present invention is directed.

The slide switches according to this invention include an electrically insulated support housing having opposing pairs of side walls which establish an interior space. An upper wall is joined to an upper edge of the opposing pairs of side walls to close an upper end of the interior space and defines an opening in communication with the interior cavity. An electrically insulated slide body which is slidably disposed within the interior space of the support housing so as to be movable reciprocally between at least first and second positions therewithin. The slide body also defines a cavity and has a knob which projects through the opening defined in the upper wall of the support housing to allow movement of the slide body between the first and second positions.

At least one pair of elongated conductors are fixed to the support housing such that the at least one pair of fixed elongate conductors extend parallel to one another but are positioned in spaced relationship transversely relative to the reciprocal movement of the slide body. The slide body includes an electrically conductive movable contact disposed in the cavity. This movable contact has a protruding contact surface which contacts both the fixed conductors when the slide body is in at least one of the first and second positions. In addition, the movable contact has an opposed pair of upturned sides which exert a bias force outwardly against the slide body cavity and to thereby frictionally retain the conductive strip within the cavity.

The movable contact itself may take several forms. Thus, for example, the movable contact may be in the form of an elongated strip having upturned sides which thereby exert the above-mentioned bias force against the slide body. The movable contact may also include upper spring flanges which are each connected integrally at one end to a respective one of the sides and which converge toward (and even possibly beyond) one another. That is, one of the upper spring flanges may define a terminal end groove, while the other spring flange includes an outwardly extending tongue disposed in such end groove.

Alternatively, the upper spring flanges may include generally C-shaped recesses which are interengaged with one another. Furthermore, the upper spring flanges may have a first inwardly turned segment connected integrally to a respective one of the sides and an outwardly turned segment connected integrally to said first segment (e.g., such that the upper spring flanges are generally U-shaped or V-shaped in profile).

Further aspects and advantages of this invention will become more clear after careful consideration is given to the following detailed description of the preferred exemplary embodiments.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
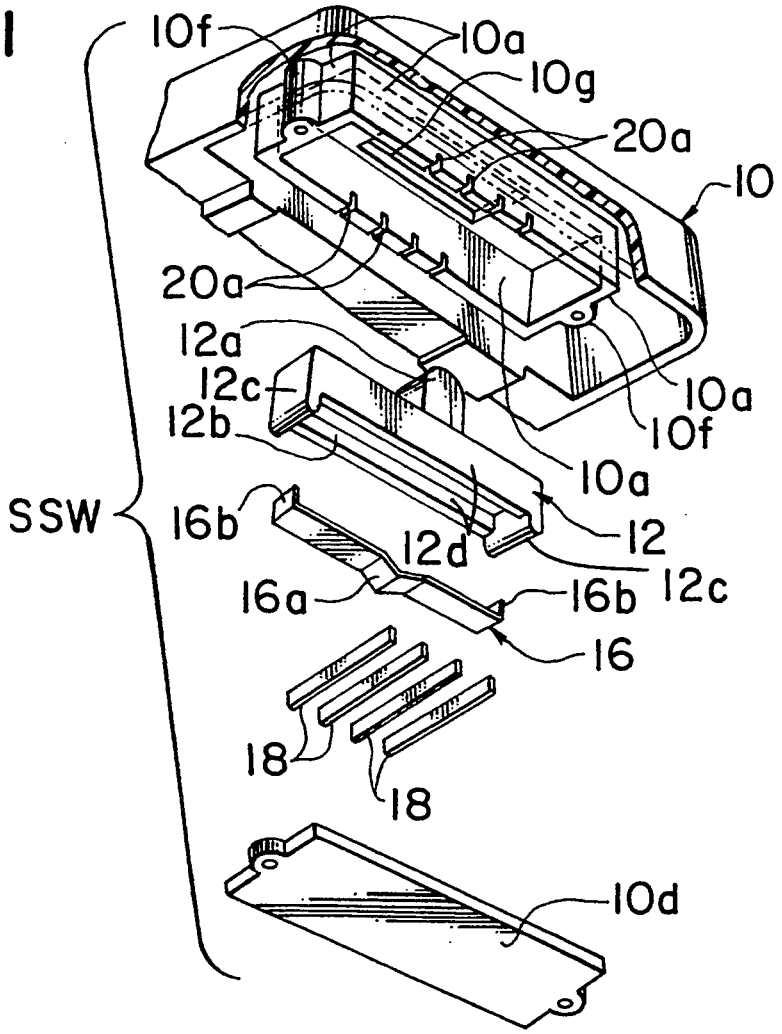
FIG. 1 is an exploded bottom perspective view of a slide switch according to this invention.
Figure 2:
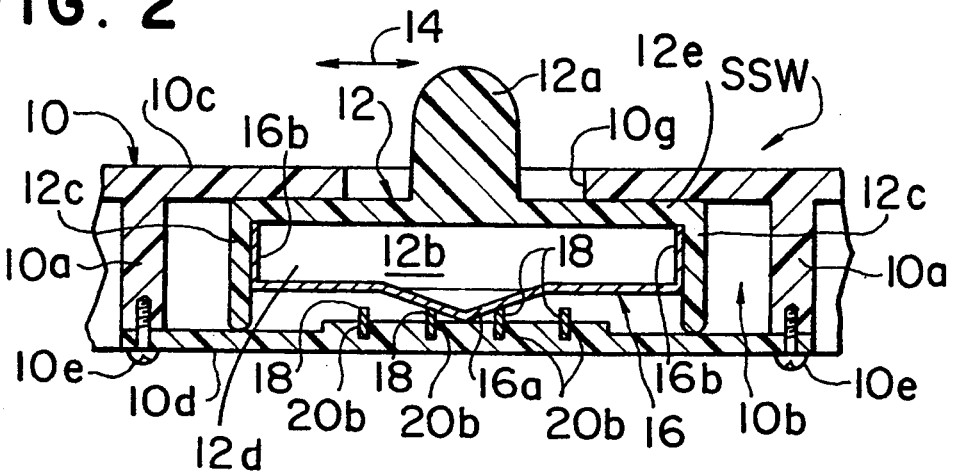
FIG. 2 is a longitudinal cross-sectional elevational view of the slide switch shown in FIG. 1.

As shown in FIGS. 1 and 2, the basic configuration of the slide switch SSW according to the present invention includes a support housing 10 which integrally includes interior walls 10*a* defining a generally inverted U-shaped (in cross-section) interior space 10*b*. The space 10*b* is closed at its upper end by a top wall 10*c* of the housing which is joined to the upper edges of the walls 10*a*. On the other hand, the space 10*b* is closed at its lower end by a bottom plate 10*d* which is rigidly joined by screws 10*e* to the bosses 10*f* associated with the longitudinally opposed pair of interior walls 10*a*. The housing 10 (including the interior walls 10*a*) is most preferably formed of an electrically insulating plastics materials.

An insulated slide body 12 (also formed of a plastics material) is movably mounted within the interior space 10*b* of the insulated support housing 10 so as to be reciprocally slidable between a number of operative positions. In this regard, the slide body 12 includes a knob 12*a* which projects externally of the housing 10 (as is shown more clearly in FIG. 2) by virtue of an elongate opening 10*g* being formed in the top wall 10*c* of the housing 10. The knob 12*a* may thus be moved manually (or automatically) so as to, in turn, cause the slide body 12 to move rectilinearly (i.e., in the direction of arrows 14 in FIG. 2) within the interior space 10*b* of the housing 10.

A resilient movable contact 16 formed of an electrically conductive material (e.g., metal) is operatively received within the interior cavity 12*b* defined in the slide body 12 by the opposed end walls 12*c*, lateral walls 12*d*, and top wall 12*e* thereof. The movable contact 16 is configured (e.g., by bending) so as to establish a substantially centrally located protruding contact member 16*a* which, in the embodiment shown, is substantially V-shaped in profile. Furthermore, important to the present invention, the movable contact 16 is bent so as to establish an opposed pair of side spring members 16*b* which are bowed slightly outwardly so as to be divergent from one another. In such a manner, when the movable contact 16 is inserted within the cavity 12*b* of the slide body 12 such that the terminal ends of the side spring members 16*b* abut against the top wall 12*e*, the side spring members 16*b* will be butted against the opposed walls 12*c* of the slide body to exert a bias force thereagainst and thereby frictionally "lock" the movable contact 16 therewithin.

A plurality of fixed conductors 18 in the form of relatively narrow strips have opposing end portions which are positioned within slots 20*a* and 20*b* formed in the latitudinally opposed pair of interior side walls 10*a* and the bottom plate 10*d*, respectively, of the housing 10. The fixed conductors 18 are thus mounted on edge—that is, so that the plane of each strip is transverse to the sliding movement of the slide body 12 (and the contact member 16*a*), but parallel to the planes of the other conductors 18. As a result, the movable contact 16 which is carried by the slide body 12 is capable of being brought into contact with a selective pair of the fixed conductors 18 simply by rectilinearly moving the knob 12*a* within the elongate space 10*g* so as to cause the slide body 12 to slide within the interior space 10*b* of the housing 10.

Figure 3:
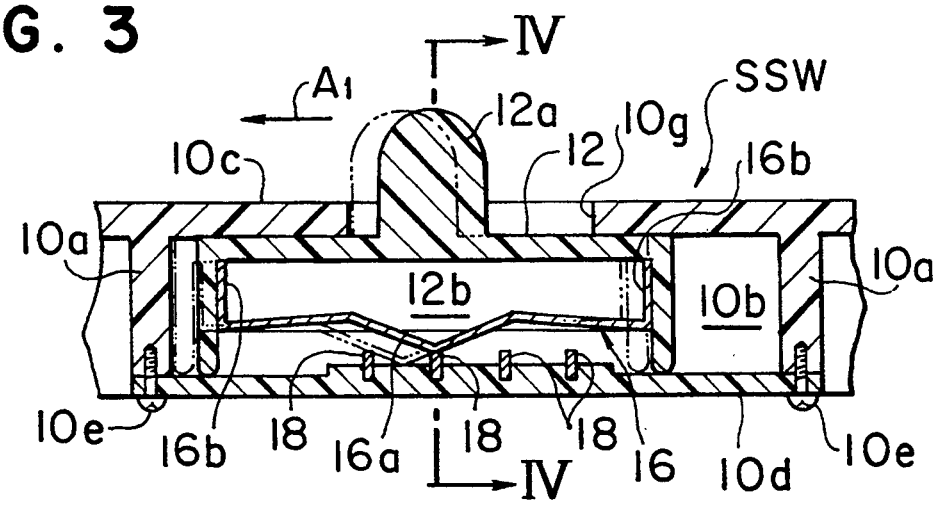
FIG. 3 is a longitudinal cross-sectional elevational view of the slide switch shown in FIG. 1 depicting movement of the slide body from a position as shown in FIG. 2 to another position (shown in phantom line in FIG. 3)

Thus, as shown in accompanying FIG. 3, as the slide body 12 is moved within the interior space 10*b* of the housing 10 (e.g., in the direction of arrow $A_1$, in FIG. 3), the resilient nature of the movable contact 16 will cause the contact member 16*a* to be displaced upwardly into the interior cavity 12*b* of the slide body 12 thereby riding over one of the fixed conductors 18. Such a state is shown in solid line in FIG. 3. Thereafter, the inherent resiliency of the strip conductor 16 will urge the contact member 16*a* outwardly relative to the cavity 12*b* of the slide body 12 and into contact with the next adjacent pair of fixed conductors 18 as shown in phantom line in FIG. 3.

Figure 4:
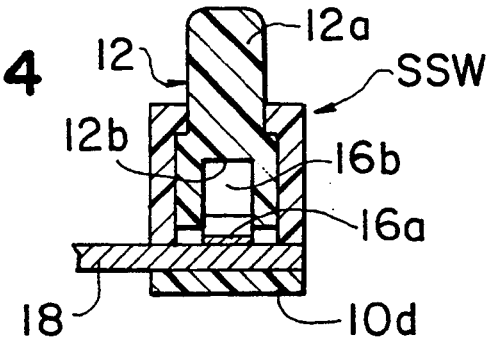
FIG. 4 is a latitudinal cross-sectional elevational view of the slide switch shown in FIG. 3 as taken along line IV—IV therein.

Preferably, as shown in FIG. 4, one end of the conductors 18 will extend from the housing 10 and thus provide a means by which the slide switch can be coupled operatively to external electrical circuits. Therefore, the slide switch of this invention can be placed into operative association with an external electrical circuit such that movement of the slide body 12 will cause the circuit to be made or broken (i.e., in dependence upon which pair of fixed conductors are spanned by the contact member 16*a*).

The assemblage of the slide switch SSW according to the present invention shown in FIGS. 1–4 is quite simple. In this regard, the movable contact 16 will first be inserted into the cavity 12*b* formed in the slide body 12 so that each of its opposed side spring members 16*b* (formed by bending terminal end portions of the movable contact 16 in an upright manner) will be brought to bear against respective ones of the walls 12*c* forming the cavity 12*b* of the slide body 12. It should be particularly noted in this regard that the side spring members 16*b* are bent so as to form a leaf-spring of sorts and thus exert an outward spring force against the walls 12*c* of the slide switch 12 forming the cavity 12*b*. As a result, when the movable contact 16 is inserted into the cavity 12*b* of the slide body 12, the side spring members 16*b* will cause the movable contact 16 to be temporarily positionally "locked" therewithin so as to minimize the risk that it might become dislodged therefrom.

With the movable contact 16 positionally locked within the cavity 12*b* of the slide body 12, the entire slide body assembly may then be inserted within the interior space 10*b* of the support housing 10. The fixed strip conductors 18 may then be inserted within their respective slot pairs 20*a*, 20*b*. The entire slide switch SSW may then be completed by securing the bottom plate 10*d* to the interior walls 10*a* by means of screws 10*e*. The thus assembled slide switch SSW may then be connected operatively to electrical circuits via the fixed conductors 18 as discussed above so as to achieve desired switching of such circuits in response to movement of the knob 12*a* (and hence the contact member 16*a* of the movable contact 16).

Figure 5:
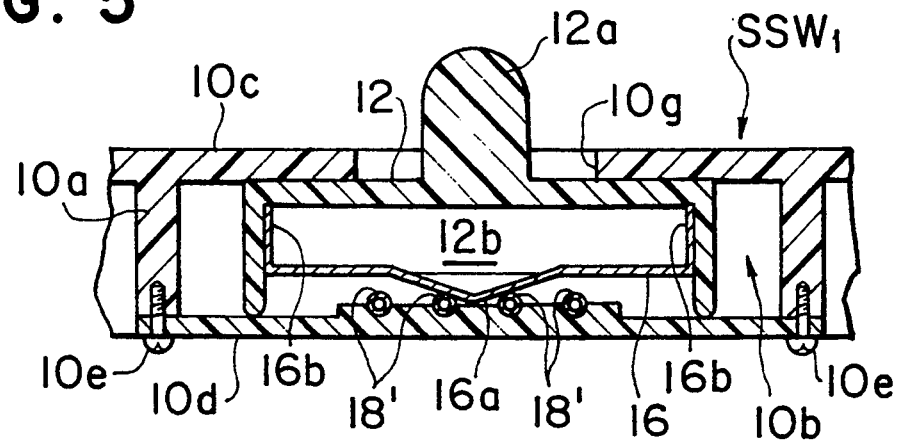
FIG. 5 is a longitudinal cross-sectional elevational view of a modified embodiment of a slide switch according to this invention.

Further embodiments and modifications of this invention will be described below, wherein the same structural elements have been identified by the same reference numerals. Furthermore, such structures have already been discussed above with reference to FIGS. 1–4, and thus no further discussion is warranted. Thus, for example, the embodiment of the slide switch $SSW_1$, shown in FIG. 5 is in all material respects identical to the slide switch SSW shown in FIGS. 1–4, except that elongate tubular members are employed as the fixed conductors 18'.

Figure 6:
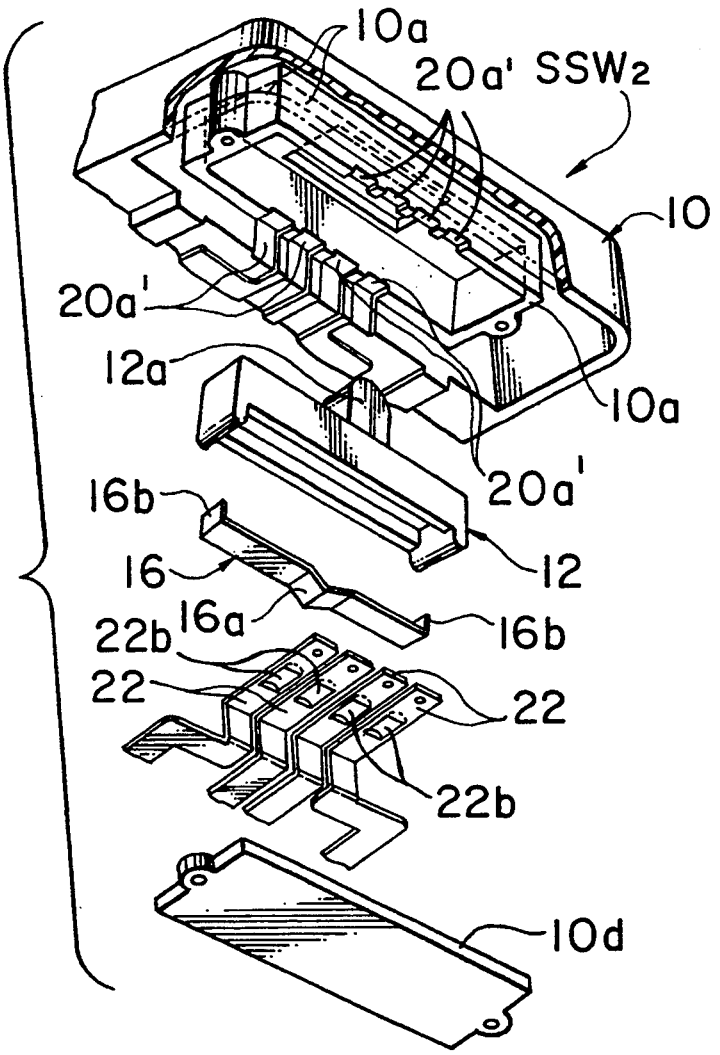
FIG. 6 is an exploded bottom perspective view of another embodiment of a slide switch according to this invention.
Figure 7:
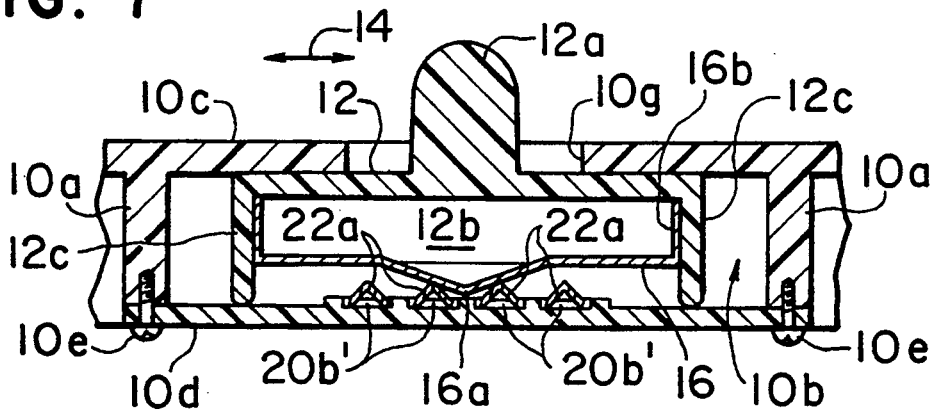
FIG. 7 is a longitudinal cross-sectional elevational view of the slide switch shown in FIG. 6.

Another embodiment of a slide switch $SSW_2$ according to this invention is shown in accompanying FIGS. 6–7. As is seen the slide switch $SSW_2$ is provided with fixed bent planar contact strips 22 which integrally include raised protuberances 22*a* in opposition to the protruding contact surface 16*a* associated with the movable contact 16. The fixed conductors 22 are, moreover, positioned so that the plane of each of the conductors 22 is parallel to the direction of movement of the slide body 12. These strip conductors 22 are, moreover, positioned and captured within appropriately sized and configured recesses 20*a*', 20*b*' formed in the latitudinally opposed pair of walls 10*a* of the housing 10 and the bottom plate 10*d*.

Therefore, according to the embodiment of slide switch $SSW_2$ shown in FIG. 6–7, when the contact member 16*a* is moved over the apex of the protuberances 22*a* in response to sliding movement of the slide body 12, the movable contact 16 will be flexed upwardly into the cavity 12*b* of the slide body 12. As a result, an increase in the resilient force of the movable contact 16 will occur which will tend to more forcibly return the contact member 16*a* to its "normal" state. Therefore, when the contact member 16*a* is moved over the protuberances 22*a*, it will seat forcibly between adjacent pairs of such protuberances 22*a* with a distinctive "clicking" action. The contact member 16*a*, will thereby be in contact with both such adjacent protuberances 22*a* as shown in FIG. 7 so as to make break an external electrical circuit as may be desired.

Figure 8:
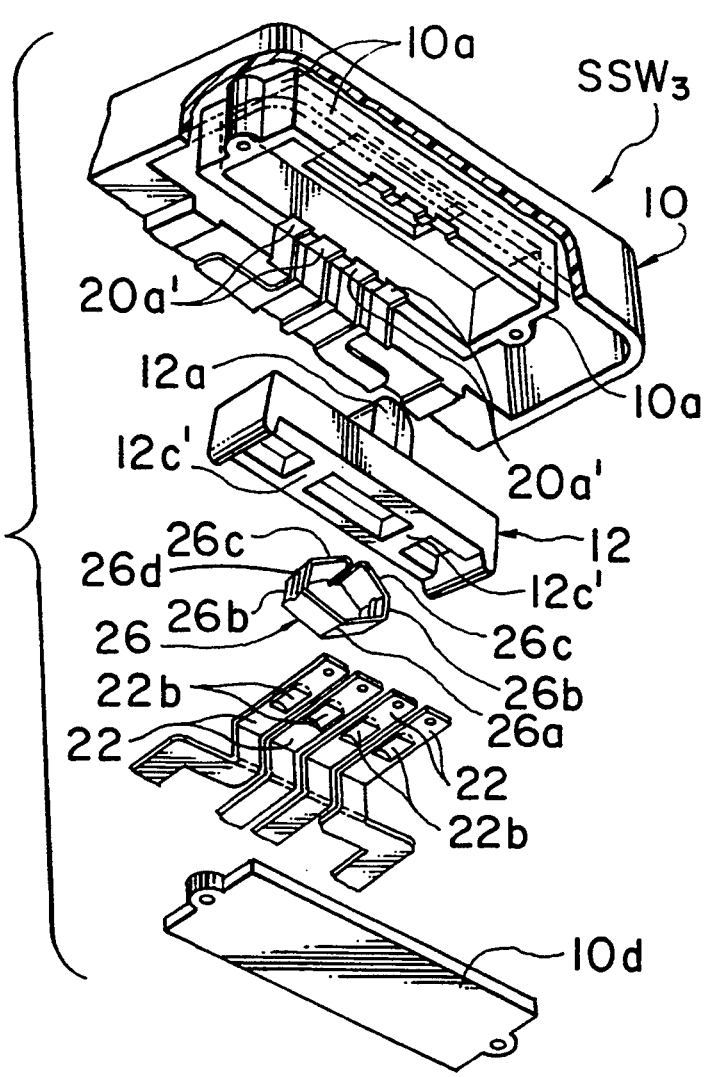
FIG. 8 is an exploded bottom perspective view of yet another embodiment of a slide switch according to this invention.
Figure 9:
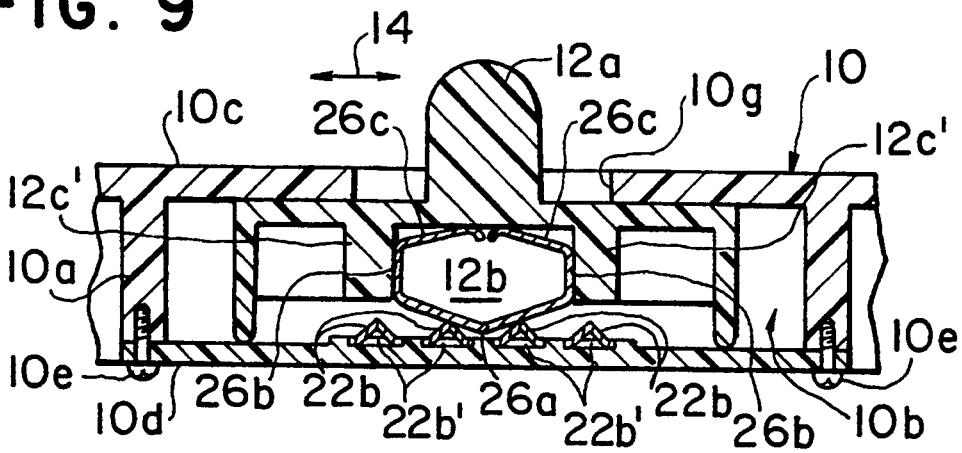
FIG. 9 is a longitudinal cross-sectional elevational view of the slide switch shown in FIG. 8.

Another embodiment of a slide switch SSW, is shown in accompanying FIGS. 8–9. As is seen, the slide switch SSW shown in FIGS. 8–9 is substantially similar to the slide switch $SSW_2$ discussed above with respect to FIGS. 6–7, with the principal exception being that the movable contact 26 is generally hexagonally shaped. More specifically, the movable contact 26 employed in the slide switch $SSW_2$ includes a pair of a generally V-shaped contact surface 26*a* and side spring flanges 26*b*. Furthermore, as can be seen the side spring flanges 26*b* include terminal regions 26*c* which are inwardly bent so that each of the terminal regions 26*c* converges toward the other.

The side spring flanges 26*b* are preferably slightly bowed and or diverge outwardly somewhat so that when the movable contact 26 is inserted into the cavity 12*b* (which in the embodiment of FIGS. 8–9 is formed by a more closely longitudinally spaced-apart end walls 12*c*') of the slide body 12, each of the side spring flanges 26 will be resiliently flexed inwardly so as to exert a bias force outwardly against the walls 12*c*' of the slide body 12 and thereby assist to frictionally "lock" the conductive strip 16 therewithin.

Furthermore, the side spring flanges 26*b* may be provided with a vertically oriented slot 26*d* extending between the junctures of the side spring flanges 26*b* with the contact member 26*a* and their respective terminal extension region 26*c* so as to enhance such resiliency. The upper terminal extension regions 26*c*, on the other hand, are canted upwardly so that their ends (which may terminate in a downwardly and inwardly curled region 26*e*, see FIG. 9) will bear against the upper wall of the slide body 12 and hence assist in providing flexion and resiliency to the entire movable contact 26 (e.g., to enhance the bias force of the movable contact 26 tending to move the same into contact with the protuberances 22*b* associated with the fixed electrical conductors 22).

Figure 10A:
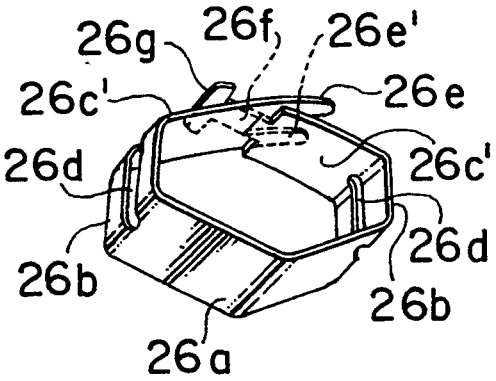
FIGS. 10A and 10B are each perspective views showing possible alternative forms of the movable contact pieces that may be used in the slide switch embodiment depicted in FIGS. 8 and 9.
Figure 10B:
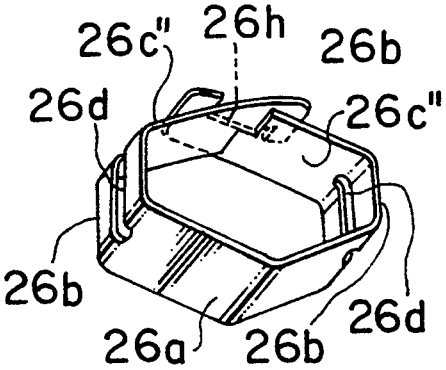

Alternative forms of the movable contact 26 which may be employed in the slide switch $SSW_3$ shown in FIGS. 8–9 are depicted in FIGS. 10A and 10B. More specifically, as shown in FIG. 10A, one of the terminal extension members 26*c*' may include a forked end 26*e* which defines an open-ended slot 26*e*' receives the tongue element 26*f* extending outwardly from the other terminal extension member 26*c*'. Furthermore, the tongue element 26*f* may be provided with a transverse head element 26*g* so as to assist in preventing uncoupling of the tongue element 26*f* and slot 26*e*'. In the embodiment of FIG. 10B, the terminal extension members 26*c*" are provided with opposed interlocked C-shaped recessed regions 26*h*. In each of the embodiments shown in FIGS. 10A and 10B, therefore, the terminal extension members 26*c* will converge to and beyond (i.e., will cross) one another so as to establish a pair of resilient tail pieces which further enhance the spring-like nature of the conductive strips.

Figure 11:
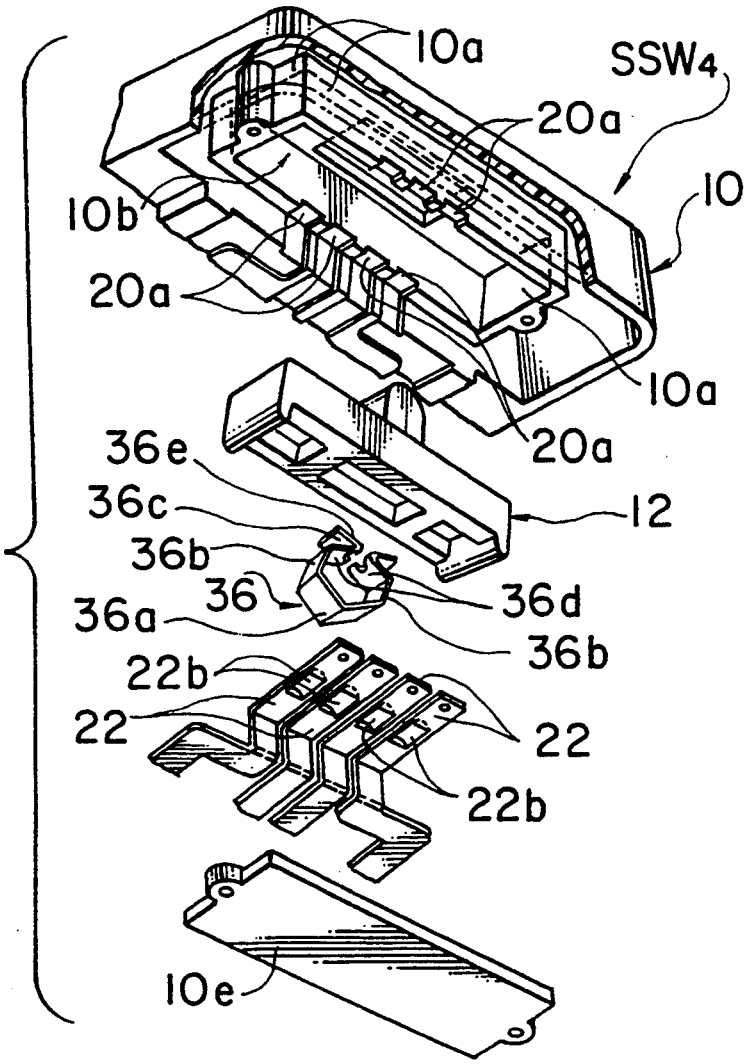
FIG. 11 is an exploded bottom perspective view of yet another embodiment of a slide switch according to this invention.
Figure 12:
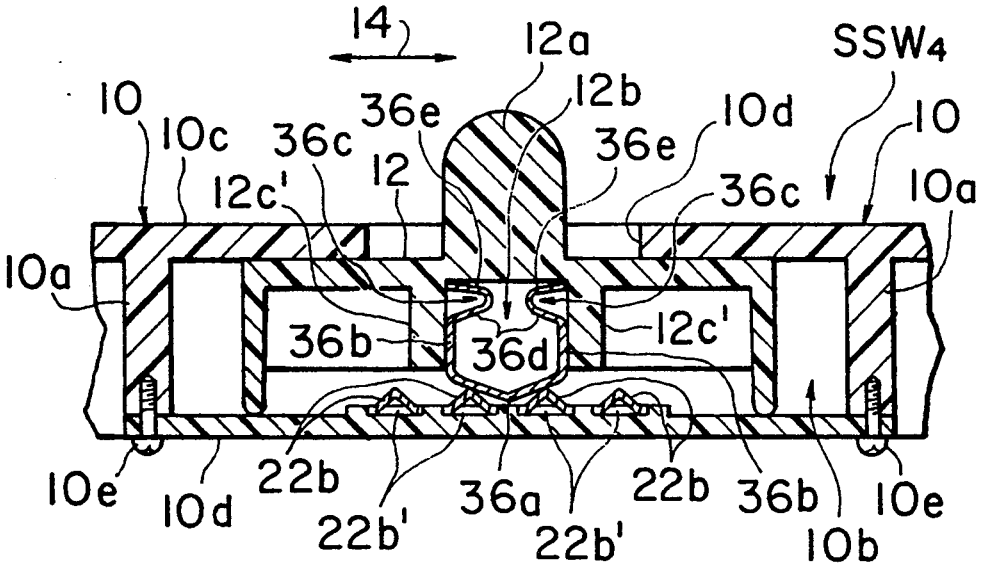
FIG. 12 is a longitudinal cross-sectional elevational view of the slide switch shown in FIG. 11.

The slide switch $SSW_4$ shown in FIGS. 11 and 12 is substantially similar to the embodiment of the slide switch $SSW_2$ discussed previously with respect to FIGS. 8–9, except that a further modified form of the movable contact 26 is employed. In this regard, the movable contact 36 shown in FIGS. 11–12 is substantially similar to the movable contact 26 shown in FIGS. 8–9 in that a contact member 36*a* and an opposed pair of side spring flanges 36*b* are provided which are structurally and functionally similar to the contact member 26*a* and side spring flanges 26*b* discussed previously.

The side spring flanges 36*b* of the movable contact 26 in the embodiment shown in FIGS. 11–12, however, each terminate in an upper spring member 36*c*. That is, the upper spring members 36*c* will each include inwardly and outwardly turned segments 36*d* and 36*e*, respectively, arranged in that order so as to form, in cross-section, an opposed pair of generally U-shaped recesses. These upper spring members 36*c* thus serve to enhance the resiliency of the movable contact conductive strip 26 within the cavity 12*b* of the slide body 12 which tends to force the contact member 36*a* into contact with the protuberances 22*a* of the fixed conductors 22.

Figure 13A:
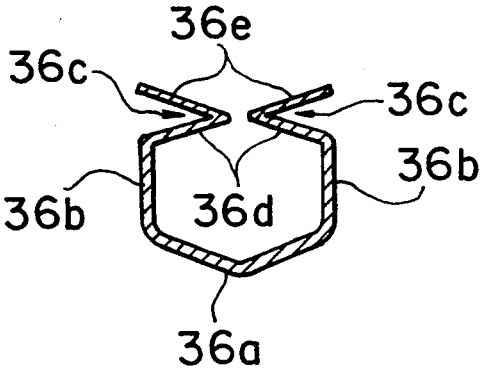
FIG. 13A and 13B are each perspective views showing possible alternative forms of the movable contact pieces that may be used in the slide switch embodiment depicted in FIGS. 11 and 12.
Figure 13B:
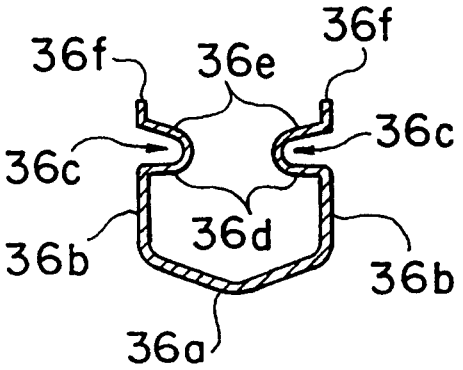

The upper ends of the side walls 36*b* do not necessarily need to be formed into a U-shape, however. In this regard, it will be observed in FIG. 13A that the inwardly and outwardly turned regions 36*d*, 36*e*, respectively may be formed into a V-shape cross-section. Furthermore, the outwardly turned regions 36*e* may themselves terminate in an upwardly directed terminal end flange 36*f* as shown in FIG. 13B.

The fixed conductors may take a variety of forms. Thus, although not shown in the accompanying drawings, the embodiments shown in FIGS. 6–7, 8–9 and 11–2 may, for example, employ the narrow strip conductors 18 as shown in FIGS. 1–2 and/or the tubular conductors 18' as shown in FIG. 5. That is, the fixed conductors may be in the form of elongate strips placed on edge (e.g., similar to the fixed contact 18 discussed above with respect to FIGS. 1–2) and/or may be tubular in form (e.g., as shown in FIG. 5).

As should now be apparent, several advantages ensue by use of the conductive strips that are employed in the slide switches of this invention. For example, since the movable contact formed according to any of the embodiments discussed above will positionally "lock" (i.e., via frictional engagement) the movable contact within the cavity defined by the slide body, the risks that it will inadvertently become separated from the other switch components during assembly are minimized. As a result, the slide switches of this invention are more readily assembled using automated techniques (e.g., robotics).

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A slide switch comprising:

an electrically insulated support housing having opposing pairs of side walls which establish an interior space, and an upper wall joined to an upper edge of said opposing pairs of side walls to close an upper end of said interior space, said upper wall defining an opening in communication with said interior cavity;

an electrically insulated slide body having a top wall and opposed pairs of end and lateral walls defining an interior cavity, said slide body being slidably disposed within said interior space of said support housing so as to be movable reciprocally between at least first and second positions therewithin, said slide body having a knob which projects through said opening defined in said upper wall of said support housing to allow movement of said slide body between said first and second positions;

at least one pair of elongate conductors fixed to said support housing such that said at least one pair of fixed elongate conductors extend parallel to one another but are positioned in spaced relationship transversely relative to said reciprocal movement of said slide body; wherein said slide body also includes an electrically conductive movable contact strip having a protruding contact surface which contacts both said fixed elongate conductors when said slide body is in at least one of said first and second positions, said movable contact strip having an opposed pair of upturned sides having outer surfaces and which terminate in free terminal ends, said movable contact strip being disposed in said cavity such that the entire outer surface of said upturned sides abut against respective ones of said opposed end walls, and such that said free terminal ends of said upturned sides abut against said top wall, said upturned sides exerting a bias force outwardly against said opposed end walls of said slide body to thereby frictionally retain said movable contact strip within said cavity.

2. A slide switch as in claim 1, wherein said fixed conductors are in the form of planar conductive strips.

3. A slide switch as in claim 2, wherein said planar conductive strips are fixed to said support housing so as to be disposed substantially perpendicular to said movable contact strip.

4. A slide switch as in claim 2, wherein said planar conductive strips include raised protuberances which are positioned so as to contact said protruding contact surface of said movable contact strip when said slide switch is moved between said first and second positions.

5. A slide switch as in claim 1, wherein said fixed conductors are tubular.

6. A slide switch as in claim 1, wherein said protruding contact surface is generally V-shaped.

* * * * *